US008398433B1

(12) United States Patent
Yang

(10) Patent No.: US 8,398,433 B1
(45) Date of Patent: Mar. 19, 2013

(54) CONNECTOR STRUCTURE

(75) Inventor: Fenny Yang, New Taipei (TW)

(73) Assignee: All Best Electronics Co., Ltd. (TW)

( * ) Notice: Subject to any disclaimer, the term of this patent is extended or adjusted under 35 U.S.C. 154(b) by 0 days.

(21) Appl. No.: 13/230,884

(22) Filed: Sep. 13, 2011

(51) Int. Cl.
*H01R 13/648* (2006.01)

(52) U.S. Cl. ..... 439/607.11; 439/92; 439/108; 439/109

(58) Field of Classification Search ..... 439/92, 439/108, 109, 386, 607.08–607.11
See application file for complete search history.

(56) References Cited

U.S. PATENT DOCUMENTS 7,871,296 B2 * 1/2011 Fowler et al. ..... 439/607.09
7,976,318 B2 * 7/2011 Fedder et al. ..... 439/79
8,157,591 B2 * 4/2012 Fedder et al. ..... 439/607.07
2004/0242071 A1 * 12/2004 Ito et al. ..... 439/608
2005/0277315 A1 * 12/2005 Mongold et al. ..... 439/108
2009/0239395 A1 * 9/2009 Cohen et al. ..... 439/65
2010/0144201 A1 * 6/2010 Defibaugh et al. ..... 439/607.05
2010/0151741 A1 * 6/2010 Fedder et al. ..... 439/638

* cited by examiner

*Primary Examiner* — James Harvey
(74) *Attorney, Agent, or Firm* — Schmeiser, Olsen & Watts, LLP

(57) ABSTRACT

A connector structure includes an enclosure; a plurality of ground units arranged in the enclosure and respectively including a carrier plate and a plurality of ground terminals electrically connected to one another and associated with the carrier plate; a plurality of signal units arranged in the enclosure side by side to locate between any two adjacent ones of the ground units, and the signal units respectively including a carrier plate and a plurality of signal terminals associated with the carrier plate; and a ground connecting member connected to the carrier plates of the ground units and the signal units. With these arrangements, the connector has simple structure and can be easily assembled for use, and the ground units are connected to the ground connecting member to thereby effectively prevent electromagnetic interference during signal transmission and ensure increased transmission rate.

7 Claims, 10 Drawing Sheets a b

CONNECTOR STRUCTURE

FIELD OF TECHNOLOGY

The present invention relates to a connector structure, and more particularly to a connector structure that is simple in structure and easy to assemble, and includes ground units connected to a ground connecting member to enable effective prevention of electromagnetic interference during signal transmission at increased transmission rate.

BACKGROUND

A conventional electrical connector, as shown in FIGS. 12 and 13, includes an enclosure 5; first and second terminal holders 6, 6*a* arranged in the enclosure 5 for supporting ground terminals 61; third and fourth terminal holders 7, 7*a* arranged in the enclosure 5 for supporting signal terminals 71; a plurality of pins 8 inserted into the enclosure 5 and extended through the terminal holders 6, 6*a*, 7, 7*a* to electrically connect to the ground terminals 61; and a plurality of conducting plates 9 connected to the ground terminals 61. With these arrangements, the electrical connector can be used for high-speed data transmission. Meanwhile, by connecting the pins 8 and the conducting plates 9 to the ground terminals 61, it is able to achieve the purpose of electromagnetic interference prevention.

However, it is considerably difficult to assemble the pins 8 and conducting plates 9 to the ground terminals 61 for electrically connecting to the latter, and it is necessary to produce and assemble the ground terminals 61, the pins 8 and the conducting plates 9 with relatively high precision for the pins 8 and conducting plates 9 to insert into the enclosure 5 and electrically connect to the ground terminals 61. That is, the conventional electrical connector has the disadvantages of complicated structure and uneasy to assemble. Moreover, since not all the ground terminals 61 are connected together, i.e. the two front ground terminals connected to one another are not connected to the two rear ground terminals that are connected to one another, an opening is formed at a rear end of the electrical connector without being effectively shielded. As a result, it is not able to effectively prevent electromagnetic interference when the electrical connector is used for signal transmission, and the transmission rate is adversely affected.

It is therefore desirable to develop an improved connector structure to overcome the problems in the conventional electrical connector.

In view of the above problems, it is tried by the inventor to develop a connector structure that is simple in structure and easy to assemble, and can be used to transmit single at high transmission rate.

SUMMARY

A primary object of the present invention is to provide an improved connector structure that is simple in structure and easy to assemble, and includes ground units connected to a ground connecting member to enable effective prevention of electromagnetic interference during signal transmission at increased transmission rate.

To achieve the above and other objects, the connector structure according to the present invention includes an enclosure; a plurality of ground units arranged in the enclosure and respectively including a carrier plate and a plurality of ground terminals electrically connected to one another and associated with the carrier plate; a plurality of signal units arranged in the enclosure side by side to locate between any two adjacent ones of the ground units, and respectively including a carrier plate and a plurality of signal terminals associated with the carrier plate; and a ground connecting member connected to the carrier plates of the ground units and the signal units.

In an embodiment of the present invention, the enclosure has a front portion provided with at least one plug section and an opposite rear portion internally defining a receiving space communicating with the plug section; the carrier plates of the ground units and the signal units are arranged in the receiving space with front ends of the ground terminals and the signal terminals held in the plug section and rear ends of the ground terminals and the signal terminals projected from a bottom of the enclosure; and the ground connecting member is located at the rear portion of the enclosure. And, the ground connecting member includes an elongated plate and a plurality of clamping sections provided on one face of the elongated plate for clamping on the ground terminals.

According to an embodiment of the present invention, only one plug section is provided in the front portion of the enclosure to communicate with the receiving space.

And, according to another embodiment of the present invention, two vertically spaced plug sections are provided in the front portion of the enclosure to communicate with the receiving space.

In a preferred embodiment of the present invention, the ground terminals of each of the ground units are embedded in the carrier plate thereof with the front and rear ends of the ground terminals projected from a front end surface and a bottom surface of the carrier plate, respectively; the carrier plates of the ground units are provided on respective rear end surface with a notch, in which the ground connecting member is fitted to connect to the carrier plates; and the ground terminals embedded in each of the carrier plates are sequentially connected to one another via a plurality of interconnecting sections to form a network. One of the interconnecting sections in each of the carrier plates is projected into the notch on the rear end surface of the carrier plate, and the clamping sections on the ground connecting member are clamped on the projected interconnecting sections.

In another preferred embodiment of the present invention, the ground terminals of each of the ground units are embedded in the carrier plate thereof with the front and rear ends of the ground terminals projected from a front end surface and a bottom surface of the carrier plate, respectively; the carrier plates of the ground units are provided on respective rear end surface with a notch, in which the ground connecting member is fitted to connect to the carrier plates; and the ground terminals embedded in each of the carrier plates are provided on an interconnecting section that is in the form of a flat sheet. The flat interconnecting sections respectively include an extended section rearward projected into the notches on the rear end surfaces of the carrier plates, and the clamping sections on the ground connecting member are clamped on the projected extended sections of the flat interconnecting sections.

In a preferred embodiment of the present invention, the signal terminals of each of the signal units are embedded in the carrier plate thereof with the front and rear ends of the signal terminals projected from a front end surface and a bottom surface of the carrier plate, respectively; and the carrier plates of the signal units are provided on respective rear end surface with a notch, in which the ground connecting member is fitted to connect to the carrier plates.

In the present invention, the clamping sections on the ground connecting member respectively include two corresponding elastic jaws; and the elastic jaws respectively have a curved shape to include a movable central contact portion.

With the above arrangements, the connector structure of the present invention is simple in structure and easy to assemble, and includes ground units all connected to a ground connecting member to enable effective prevention of electromagnetic interference during signal transmission at increased transmission rate.

BRIEF DESCRIPTION

The structure and the technical means adopted by the present invention to achieve the above and other objects can be best understood by referring to the following detailed description of the preferred embodiments and the accompanying drawings, wherein FIG. 1 is a rear exploded perspective view of a connector structure according to a first embodiment of the present invention;

DETAILED DESCRIPTION

The present invention will now be described with some preferred embodiments thereof and with reference to the accompanying drawings.

Figure 1:
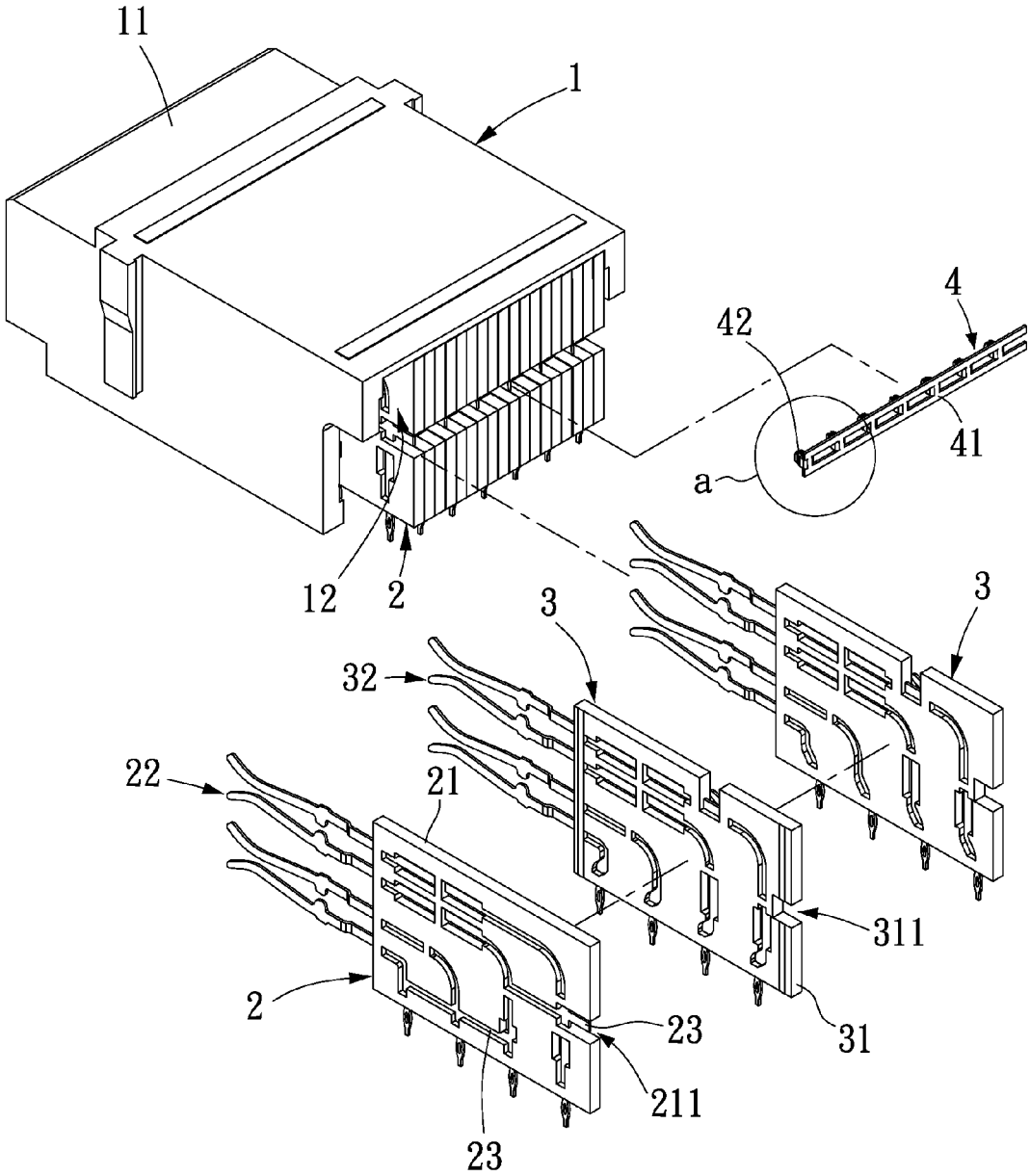
Figure 2:
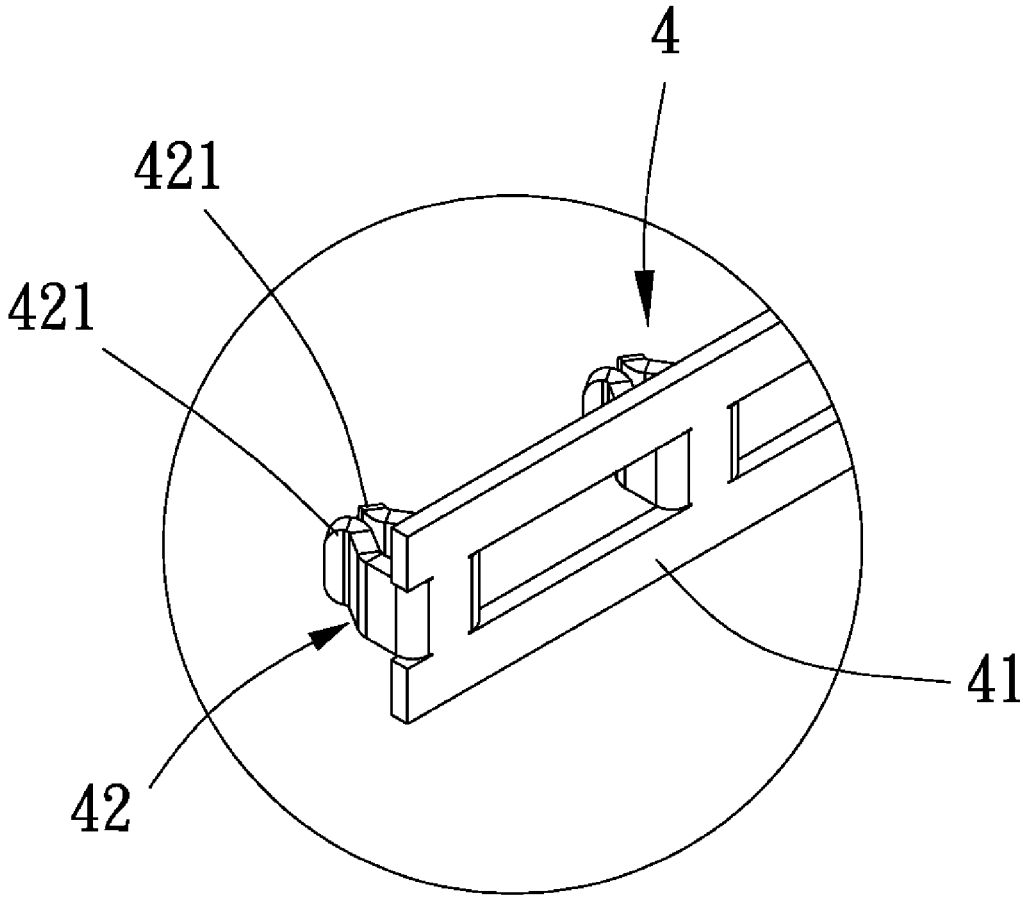
FIG. 2 is an enlarged view of the circled area "a" in FIG. 1.
Figure 3:
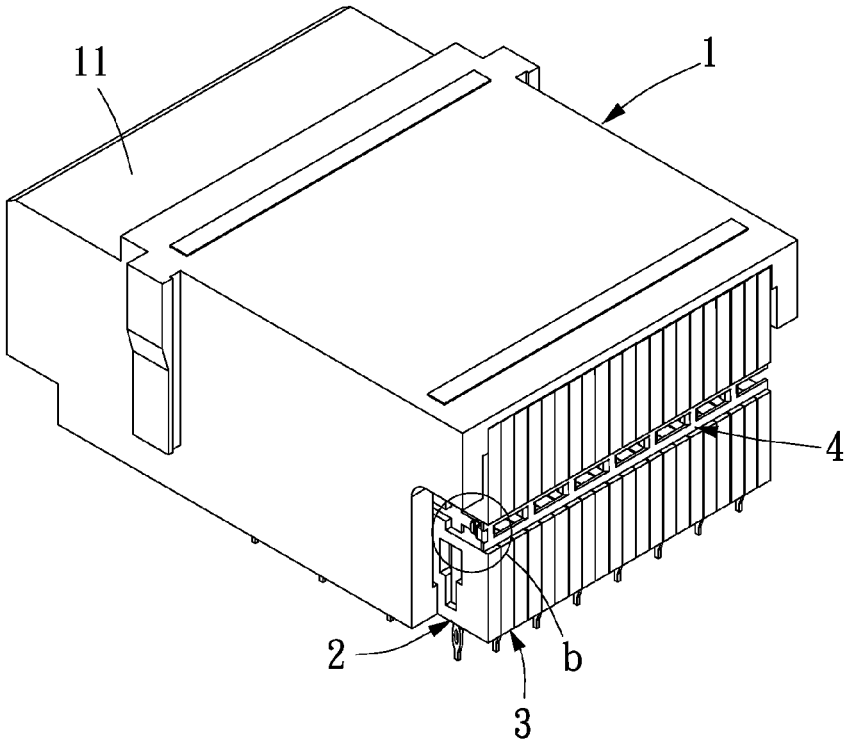
FIG. 3 is an assembled view of FIG. 1.
Figure 4:
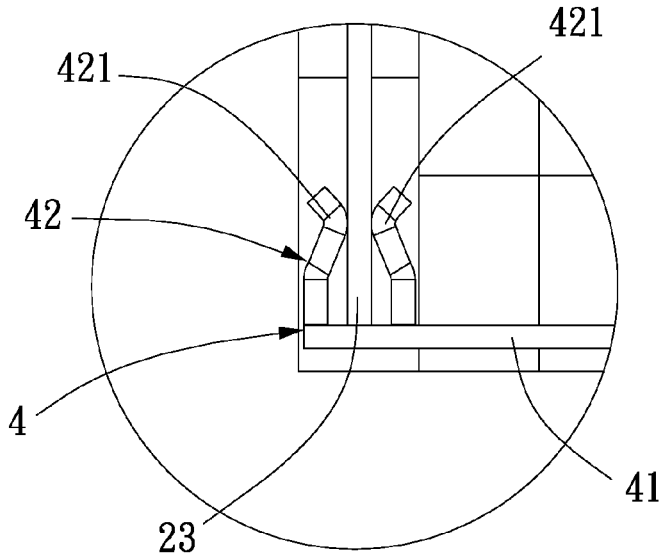
FIG. 4 is an enlarged view of the circled area "b" in FIG. 3.
Figure 5:
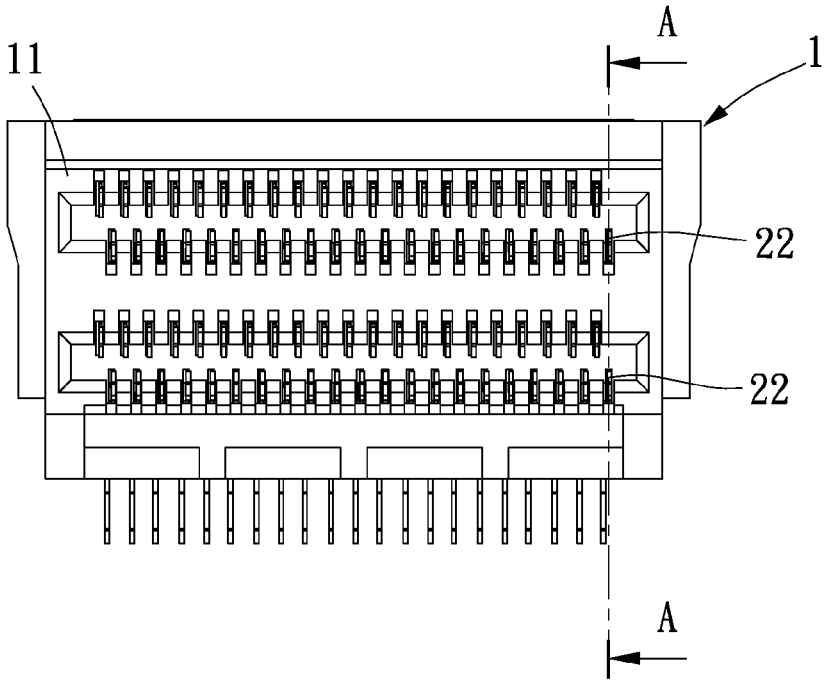
FIG. 5 is a front view of the connector structure according to the first embodiment of the present invention.
Figure 6:
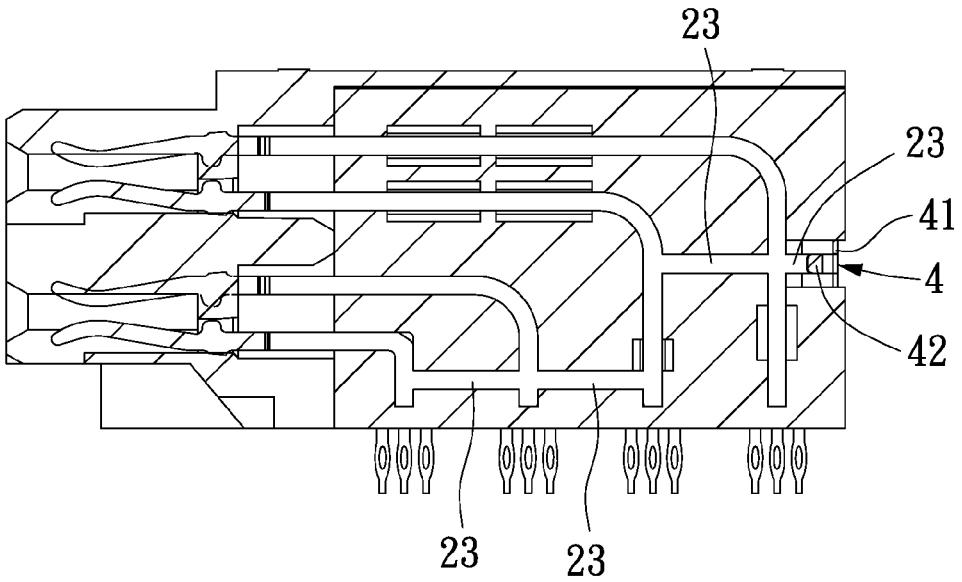
FIG. 6 is a sectional view taken along line A-A of FIG. 5.

Please refer to FIGS. 1 through 6, in which FIGS. 1 and 3 are rear exploded and assembled perspective views, respectively, of a connector structure according to a first embodiment of the present invention, FIGS. 2 and 4 are enlarged views of the circled areas "a" and "b" in FIGS. 1 and 3, respectively, FIG. 5 is a front view of the connector structure of FIG. 3, and FIG. 6 is a sectional view taken along line A-A of FIG. 5. As shown, the connector structure in the first embodiment includes an enclosure 1, a plurality of grounding units 2, a plurality of signal units 3, and a ground connecting member 4.

The enclosure 1 has a front portion provided with a plug section 11 and an opposite rear portion internally defining a receiving space 12 communicating with the plug section 11.

The ground units 2 are arranged in the receiving space 12 of the enclosure 1 and respectively include a carrier plate 21 and a plurality of electrically connected ground terminals 22 associated with the carrier plate 21. In the illustrated first embodiment, four ground terminals 22 are shown, and the ground terminals 22 are embedded in the carrier plate 21. Each of the ground terminals 22 has a front end and an opposite rear end being extended to project from a front end surface and a bottom surface of the carrier plate 21, respectively, such that the front ends of the ground terminals 22 are held in the plug section 11 while the rear ends of the ground terminals 22 are projected from a bottom of the enclosure 1. Further, the carrier plates 21 are respectively provided at a rear end surface with a notch 211; and the ground terminals 22 embedded in the same carrier plate 21 are sequentially connected to one another via a plurality of interconnecting sections 23 to form a network. It is noted one of the interconnecting sections 23 is projected into the notch 211 on the carrier plate 21.

The signal units 3 are arranged in the receiving space 12 of the enclosure 1 side by side, such that the signal units 3 are located between two adjacent ground units 2. Each of the signal units 3 includes a carrier plate 31 and a plurality of signal terminals 32 associated with the carrier plate 31. In the illustrated first embodiment, four signal terminals 32 are shown, and the signal terminals 32 are embedded in the carrier plate 31. Each of the signal terminals 32 has a front end and an opposite rear end being extended to project from a front end surface and a bottom surface of the carrier plate 31, respectively, such that the front ends of the signal terminals 22 are held in the plug section 11 while the rear ends of the signal terminals 32 are projected from the bottom of the enclosure 1. Further, the carrier plates 31 are respectively provided at a rear end surface with a notch 311.

The ground connecting member 4 is fitted on the carrier plates 21, 32 of the ground units 2 and the signal units 3 to connect with the ground terminals 22. The ground connecting member 4 includes an elongated plate 41 and a plurality of clamping sections 42 provided on one face of the elongated plate 41. The clamping sections 42 respectively include two corresponding elastic jaws 421, which respectively have a substantially curved body to define a movable central contact portion. The elongated plate 41 is fitted in the notches 211, 311 of the carrier plates 21, 31 with the elastic jaws 421 of the clamping sections 42 clamped on the interconnecting sections 23 projected into the notches 211.

To assemble the connector structure of the present invention, first position the ground units 2 and the signal units 3 in the enclosure 1 with the carrier plates 21, 31 located in the receiving space 12, such that the ground units 2 and the signal units 3 are arranged side by side. In the illustrated first embodiment, any two adjacent ground units 2 have two signal units 3 sandwiched therebetween. However, it is understood the present invention is not limited to the illustrated first embodiment and the number of signal units 3 being sandwiched between two adjacent ground units 2 can be determined according to actual need. Further, the carrier plates 21 and the carrier plates 31 are located in the receiving space 12 with the front ends of the ground terminals 22 and the signal terminals 32 held in the plug section 11 and the rear ends of the ground terminals 22 and the signal terminals 32 projected from the bottom of the enclosure 1. Thereafter, fit the elongated plate 41 of the ground connecting member 4 in the notches 211, 311 of the carrier plates 21, 31, such that the elastic jaws 421 of the clamping sections 42 are clamped on the interconnecting sections 23 that are projected into the notches 211. A connector with simple structure and easy to assemble is then completed. To use the connector structure of the present invention, simply connect the rear ends of the ground terminals 22 and the signal terminals 32 projected from the bottom of the enclosure 1 to a circuit board (not shown), and connect a corresponding connector on an electronic device to the plug section 11, so that the electronic device is electrically connected to the front ends of the ground terminals 22 and the signal terminals 32 held in the plug section 11 and can be used for high-speed data transmission.

When the connector structure is in use, since the ground terminals 22 connected to one another via the interconnecting sections 23 together form a net structure for electromagnetic wave prevention, and the ground terminals 22 are also connected to the ground connecting member 4, it is able to effectively prevent electromagnetic interference during signal transmission to thereby achieve improved transmission rate.

Figure 7:
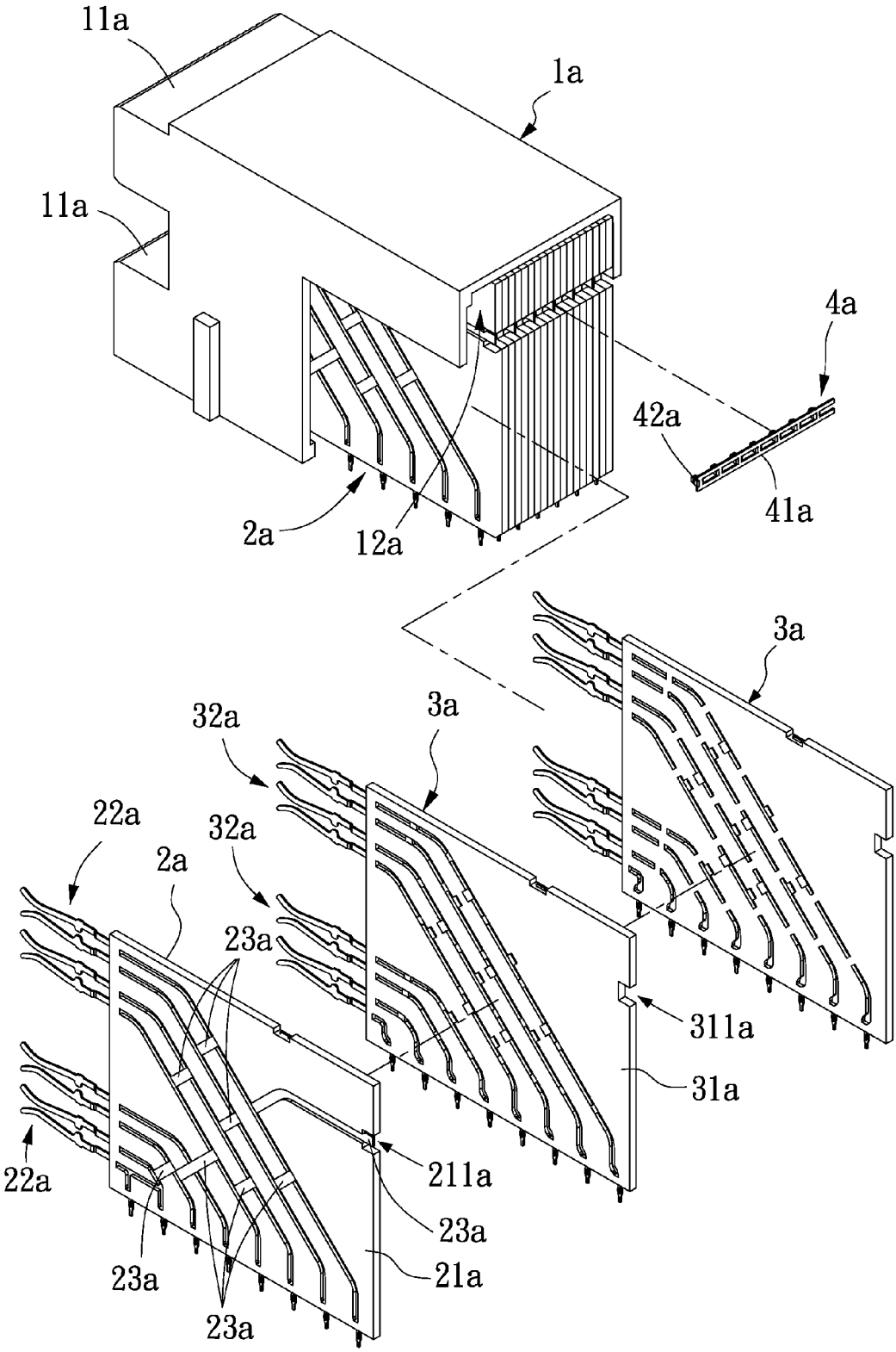
FIG. 7 is a rear exploded perspective view of a connector structure according to a second embodiment of the present invention.
Figure 8:
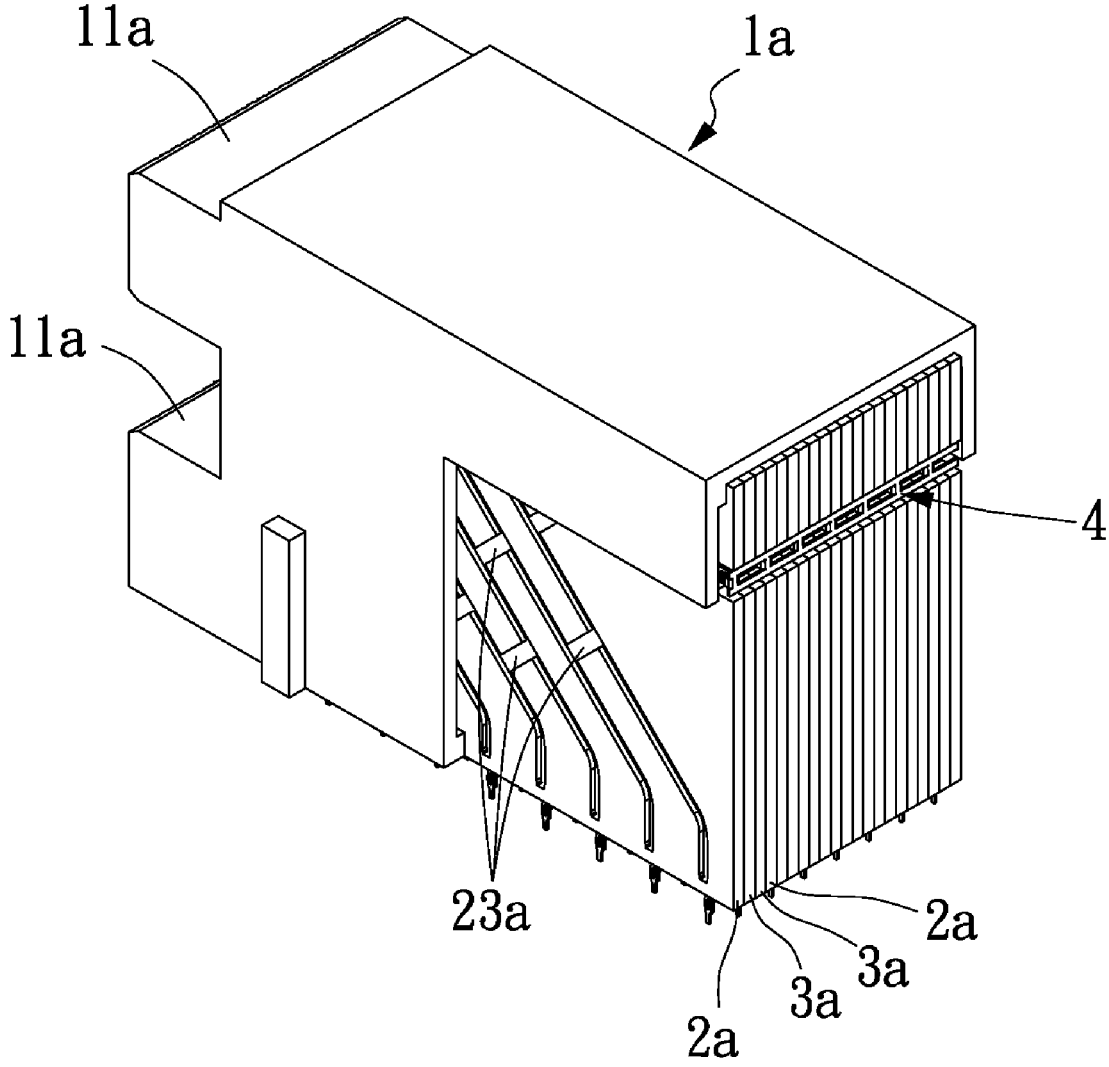
FIG. 8 is an assembled view of FIG. 7.
Figure 9:
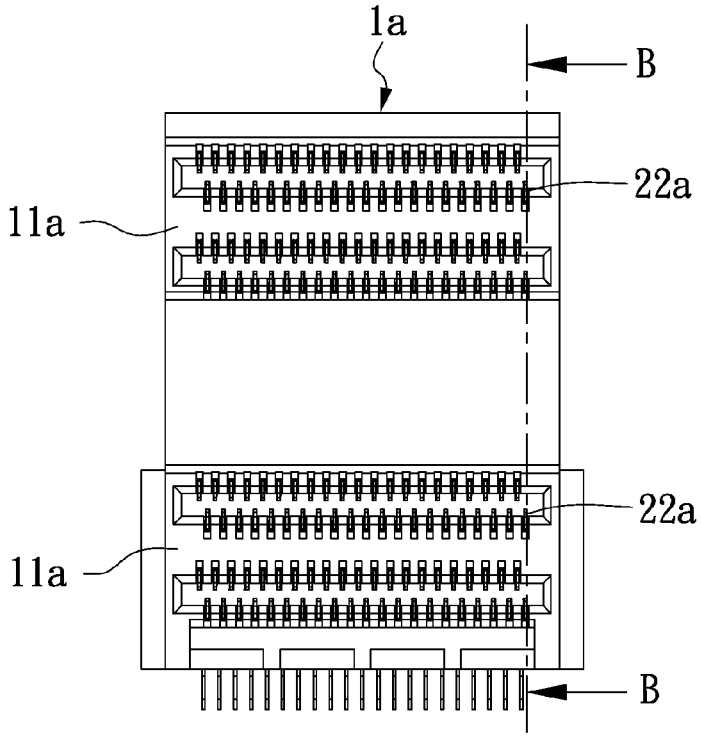
FIG. 9 is a front view of the connector structure according to the second embodiment of the present invention.
Figure 10:
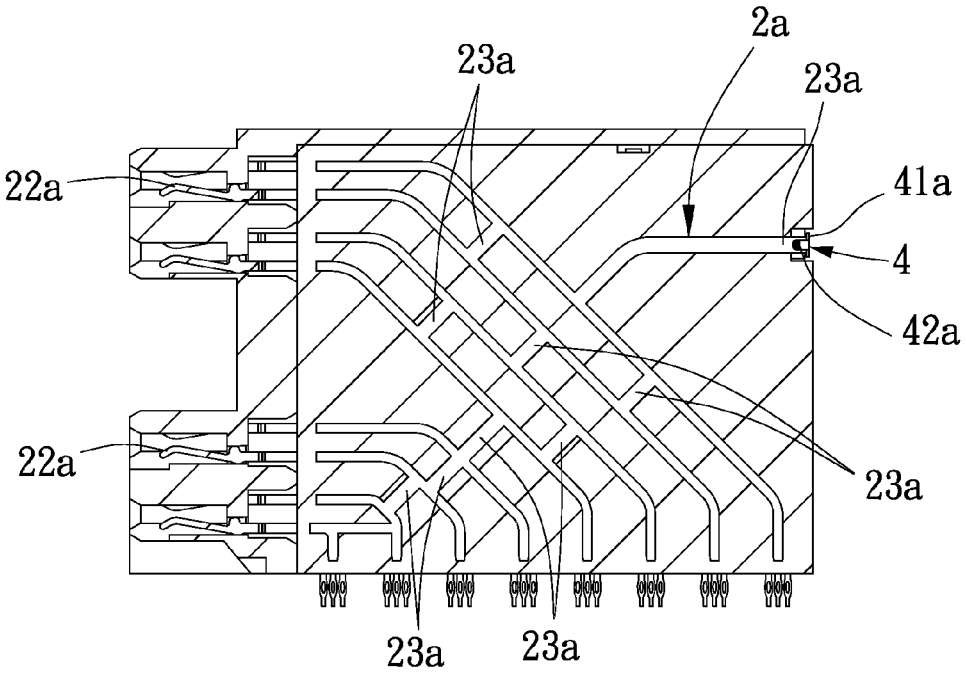
FIG. 10 is a sectional view taken along line B-B of FIG. 9.

Please refer to FIGS. 7 through 10, in which FIGS. 7 and 8 are rear exploded and assembled perspective views, respectively, of a connector structure according to a second embodiment of the present invention, FIG. 9 is a front view of FIG. 8, and FIG. 10 is a sectional view taken along line B-B of FIG. 9. As shown, the second embodiment is generally structurally similar to the first embodiment, except that the enclosure 1*a* in the second embodiment has a front portion provided with two vertically spaced plug sections 11*a*, which are communicable with the receiving space 12*a* defined in the rear portion of the enclosure 1*a*. For this purpose, the ground units 2*a* and the signal units 3*a* in the second embodiment have size-increased carrier plates 21*a*, 31*a*, and there are total eight, namely, four upper and four lower, ground terminals 22*a* provided on each of the carrier plates 21*a*, as well as total eight, namely, four upper and four lower, signal terminals 32*a*, provided on each of the carrier plates 31*a*. The upper and lower ground terminals 22*a* and signal terminals 32*a* have their front ends held in the upper and lower plug sections 11*a*, respectively, and rear ends projected from the bottom of the enclosure 1*a*. The ground connecting member 4*a* in the second embodiment similarly has an elongated plate 41*a* fitted in the notches 211*a*, 311*a* on the rear end surfaces of the ground units 2*a* and signal units 3*a*, and a plurality of clamping sections 42*a* clamped on the interconnecting sections 23*a* projected into the notches 211*a*. With these arrangements, a two-level connector structure is formed to achieve the same effect and function as the connector structure according to the first embodiment.

Figure 11:
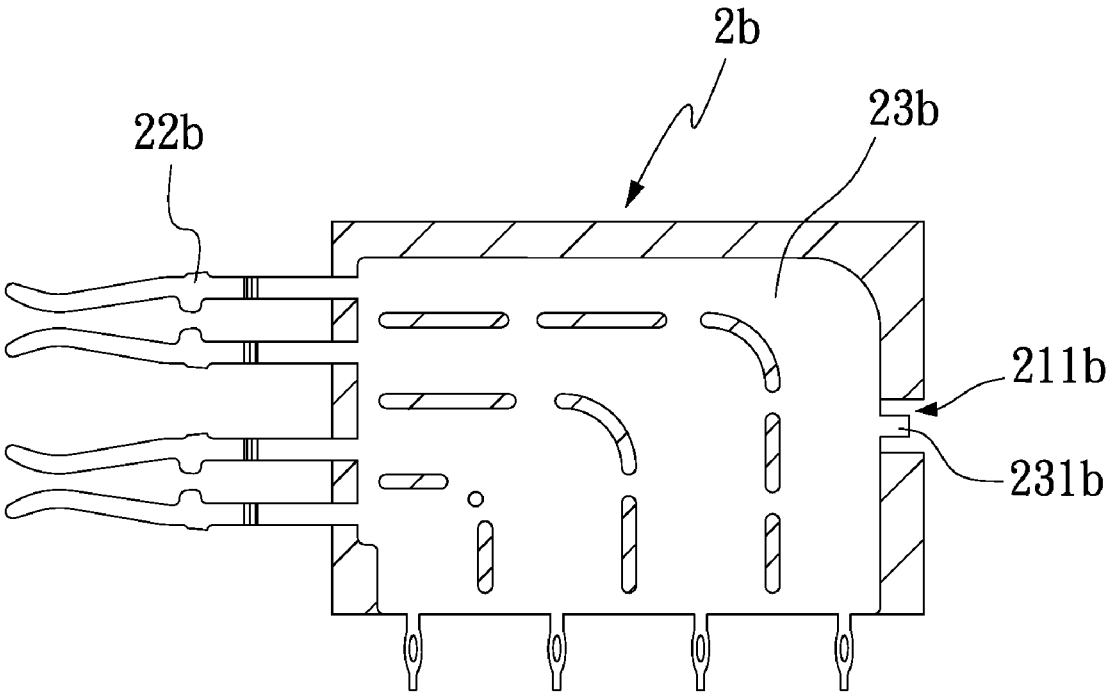
FIG. 11 is a sectional view of a connector structure according to a third embodiment of the present invention.
Figure 12:
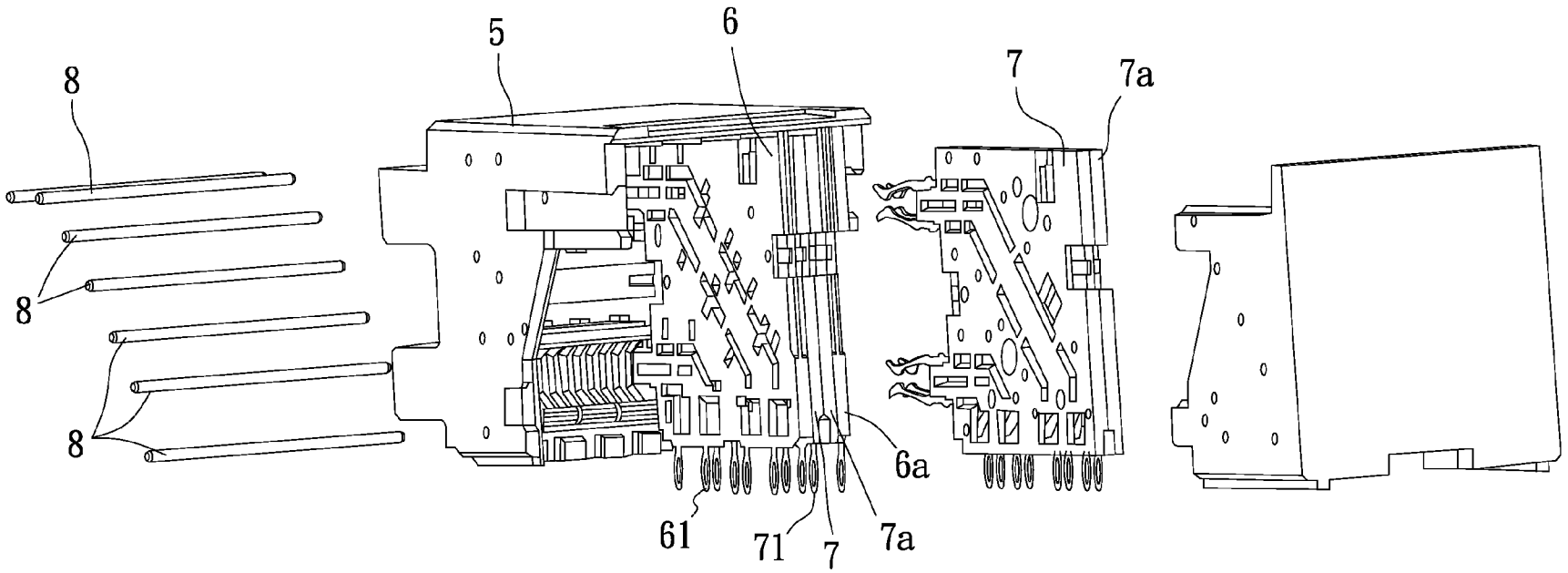
(PRIOR ART) FIG. 12
FIG. 12 is an exploded perspective view of a conventional electrical connector.
Figure 13:
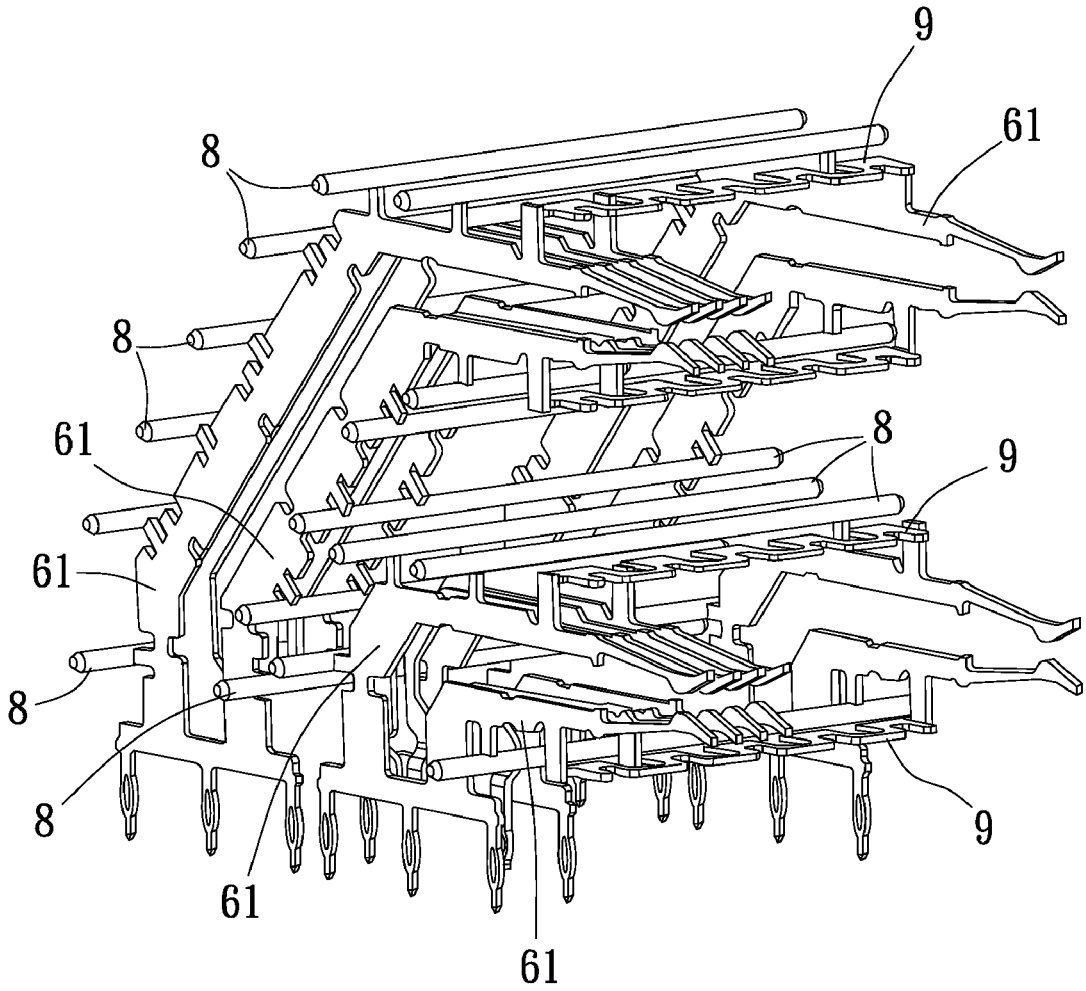
(PRIOR ART) FIG. 13
FIG. 13 is a perspective view showing the arrangement of ground terminals, pins and conducting plates in the conventional electrical connector of FIG. 12.

FIG. 11 is a sectional view of a connector structure according to a third embodiment of the present invention. As shown, the third embodiment is generally structurally similar to the first and the second embodiment, except that the ground terminals 22*b* in each ground unit 2*b* of the third embodiment are provided on an interconnecting section 23*b* that is in the form of a flat sheet. The flat interconnecting sections 23*b* respectively include an extended section 231*b* rearward projected into notches 211*b* provided on rear ends of the ground units 2*b*, so that the extended sections 231*b* can be clamped by the clamping sections of the ground connecting member (not shown in FIG. 11). With these arrangements, the interconnecting sections 23*b* in the form of flat sheets can effectively prevent electromagnetic interference during signal transmission.

With the above arrangements, the present invention is novel and improved because the connector has simple structure and can be easily assembled for use, and the ground units are connected to the ground connecting member to enable effective prevention of electromagnetic interference during signal transmission at increased transmission rate. The present invention is also industrially useful because products derived from the present invention would no doubt satisfy the current market demands.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A connector structure, comprising:

an enclosure having a front portion provided with at least one plug section and an opposite rear portion internally defining a receiving space communicating with the at least one plug section;

a plurality of ground units being arranged in the enclosure, and respectively including a carrier plate and a plurality of ground terminals electrically connected to one another and associated with the carrier plate;

a plurality of signal units being arranged in the enclosure side by side to locate between any two adjacent ones of the ground units; and the signal units respectively including a carrier plate and a plurality of signal terminals associated with the carrier plate; and a ground connecting member being connected to the carrier plates of the ground units and the signal units, being located at the rear portion of the enclosure, and including an elongated plate and a plurality of clamping sections provided on a face of the elongated plate for clamping on the ground terminals;

wherein the carrier plates of the ground units and the signal units are arranged in the receiving space, such that front ends of the ground terminals and the signal terminals are held in the at least one plug section, and rear ends of the ground terminals and the signal terminals are projected from a bottom of the enclosure.

2. The connector structure as claimed in claim 1, wherein the clamping sections respectively include two corresponding elastic jaws; and the elastic jaws respectively having a curved shape to include a movable central contact portion.

3. The connector structure as claimed in claim 1, wherein only one of the at least one plug section is provided in the front portion of the enclosure to communicate with the receiving space.

4. The connector structure as claimed in claim 1, wherein two vertically spaced plug sections included in the at least one plug section are provided in the front portion of the enclosure to communicate with the receiving space.

5. The connector structure as claimed in claim 1, wherein the ground terminals of each of the ground units are embedded in the carrier plate thereof with the front and rear ends of the ground terminals projected from a front end surface and a bottom surface of the carrier plate, respectively; and wherein the carrier plates of the ground units are provided on respective rear end surface with a notch, in which the ground connecting member is fitted to connect to the carrier plates of the ground units; and wherein the ground terminals embedded in each of the carrier plates are sequentially connected to one another via a plurality of interconnecting sections to form a network; one of the interconnecting sections in each of the carrier plates of the ground units being projected into the notch on the rear end surface of the carrier plate, and the clamping sections on the ground connecting member being clamped on the projected interconnecting sections.

6. The connector structure as claimed in claim 1, wherein the ground terminals of each of the ground units are embedded in the carrier plate thereof with the front and rear ends of the ground terminals projected from a front end surface and a bottom surface of the carrier plate, respectively; and wherein the carrier plates of the ground units are provided on respective rear end surface with a notch, in which the ground connecting member is fitted to connect to the carrier plates of the ground units; and wherein the ground terminals embedded in each of the carrier plates are provided on an interconnecting section that is in the form of a flat sheet; the flat interconnecting sections respectively including an extended section rearward projected into the notches on the rear end surfaces of the carrier plates of the ground units, and the clamping sections on the ground connecting member being clamped on the projected extended sections of the flat interconnecting sections.

7. The connector structure as claimed in claim 1, wherein the signal terminals of each of the signal units are embedded in the carrier plate thereof with the front and rear ends of the signal terminals projected from a front end surface and a bottom surface of the carrier plate, respectively; and wherein the carrier plates of the signal units are provided on respective rear end surface with a notch, in which the ground connecting member is fitted to connect to the carrier plates of the signal units.

* * * * *